US006601241B1

(12) United States Patent
Skotzke

(10) Patent No.: US 6,601,241 B1
(45) Date of Patent: Aug. 5, 2003

(54) TOILET SEAT LIFTER

(76) Inventor: David L. Skotzke, 3760 S. 56th St., Greenfield, WI (US) 53220

( * ) Notice: Subject to any disclaimer, the term of this patent is extended or adjusted under 35 U.S.C. 154(b) by 0 days.

(21) Appl. No.: 10/104,762

(22) Filed: Mar. 25, 2002

(51) Int. Cl.[7] ..... A47K 13/10
(52) U.S. Cl. ..... 4/246.1
(58) Field of Search ..... 4/246.1, 246.3

(56) References Cited

U.S. PATENT DOCUMENTS 2,954,565 A * 10/1960 Miller ..... 4/246.3
4,150,446 A 4/1979 Crocker ..... 4/251
4,426,743 A * 1/1984 Seabrooke ..... 4/246.3
4,470,161 A * 9/1984 Seabrooke ..... 4/246.3
4,975,988 A * 12/1990 Won ..... 4/246.3
5,103,506 A 4/1992 Munford et al. ..... 4/251
5,659,902 A * 8/1997 Roberts, Jr. ..... 4/246.3
6,112,336 A * 9/2000 Markle et al. ..... 4/246.1
6,263,517 B1 7/2001 Brooks ..... 4/246.1

* cited by examiner

*Primary Examiner*—Charles E. Phillips
(74) *Attorney, Agent, or Firm*—Donald J. Ersler

(57) ABSTRACT

A toilet seat lifter includes a seat lifter, a foot pedal actuator, and an actuation cable. The seat lifter includes a lifter base and at least one lifter arm. The lifter base is retained between a toilet a toilet seat assembly on one end thereof. The at least one lifter arm is rotatably retained by the lifter base on the other end thereof. The at least one lifter arm is placed under the toilet seat. The foot pedal actuator includes a base, a foot pedal, and a spring loaded disc. The spring loaded disc is rotatably retained by the base. One end of the foot pedal is pivotally attached to the base and other end rotates the spring loaded disc. One end of the cable is attached to the spring loaded disc and the other end is attached to the at least one lifter arm. When a user pushes the foot pedal down the cable rotates the at least one lifter arm to raise the toilet seat.

13 Claims, 5 Drawing Sheets

TOILET SEAT LIFTER

BACKGROUND OF THE INVENTION

1. Field of the Invention

The present invention relates generally to toilets and more specifically to a toilet seat lifter which enables a toilet seat to be lifted with a foot.

2. Discussion of the Prior Art

The prior art contains several toilet seat lifters. Some of the toilet seat lifters include U.S. Pat. No. 4,150,446 to Crocker, U.S. Pat. No. 5,103,506 to Munford et al., and U.S. Pat. No. 6,263,517 to Brooks. Each of these toilet seat lifters disclose a foot pedal which is intended to be anchored in one location only. However, Crocker discloses a bare cable and a "V" shaped lever pivotally attached to a base. A bare cable fabricated from steel will rust and may provide a cutting hazard. The "V" shaped lever has at least one potential pinch point with the base.

Accordingly, there is a clearly felt need in the art for a toilet seat lifter which may be easily installed on a toilet; has a movable foot, pedal actuator to accommodate the needs of a particular user; and has a foot pedal actuator without pinch points.

SUMMARY OF THE INVENTION

The present invention provides a toilet seat lifter which may be easily installed on a toilet. The toilet seat lifter includes a seat lifter, a foot pedal actuator, and an actuation cable. The actuation cable includes a cable and a sheath. The seat lifter includes a lifter base and at least one lifter arm. The lifter base includes slots for attaching thereof to anchor bolts of a toilet seat on one end. The at least one lifter arm is rotatably retained by the lifter base on the other end thereof. One end of the cable is retained by the at least one lifter arm such that when the cable is pulled, the at least one lift arm has rotary movement.

The foot pedal actuator includes a foot base, a foot pedal, and a spring loaded disc. The foot base includes a disc yoke which extends. The spring loaded disc is pivotally retained in the disc yoke. The sheath is retained between an end of the disc yoke and the one end of the lifter base. A pedal projection extends outward from the outer diameter of the spring loaded disc. The other end of the cable is retained by pedal projection. One end of the foot pedal is pivotally attached to the floor member and the other end of the foot pedal rests on the pedal projection.

The toilet seat lifter preferably operates in the following manner. The slots of the lifter base are slipped around the anchor bolts of the toilet seat assembly, between the toilet and the toilet base. The at least one lifter arm is located below a bottom of the toilet seat. The foot pedal actuator may be located on either the left or right side of the toilet in a comfortable position. The toilet seat in a down position forces the foot pedal into an elevated position. To lift the toilet seat, the user presses their foot on the foot pedal which causes the at least one lifter arm to rotate and push the toilet seat upward. When the user takes their foot off the foot pedal, a torsion spring in the spring loaded disc allows the toilet seat to retract slowly.

Accordingly, it is an object of the present invention to provide a toilet seat lifter which may be easily installed on a toilet.

It is a further object of the present invention to provide a toilet seat lifter which has a movable foot pedal actuator to accommodate the needs of a particular user.

Finally, it is another object of the present invention to provide a toilet seat lifter which includes a foot pedal actuator without a potential pinch point.

These and additional objects, advantages, features and benefits of the present invention will become apparent from the following specification.

DETAILED DESCRIPTION OF THE PREFERRED EMBODIMENTS

Figure 1:
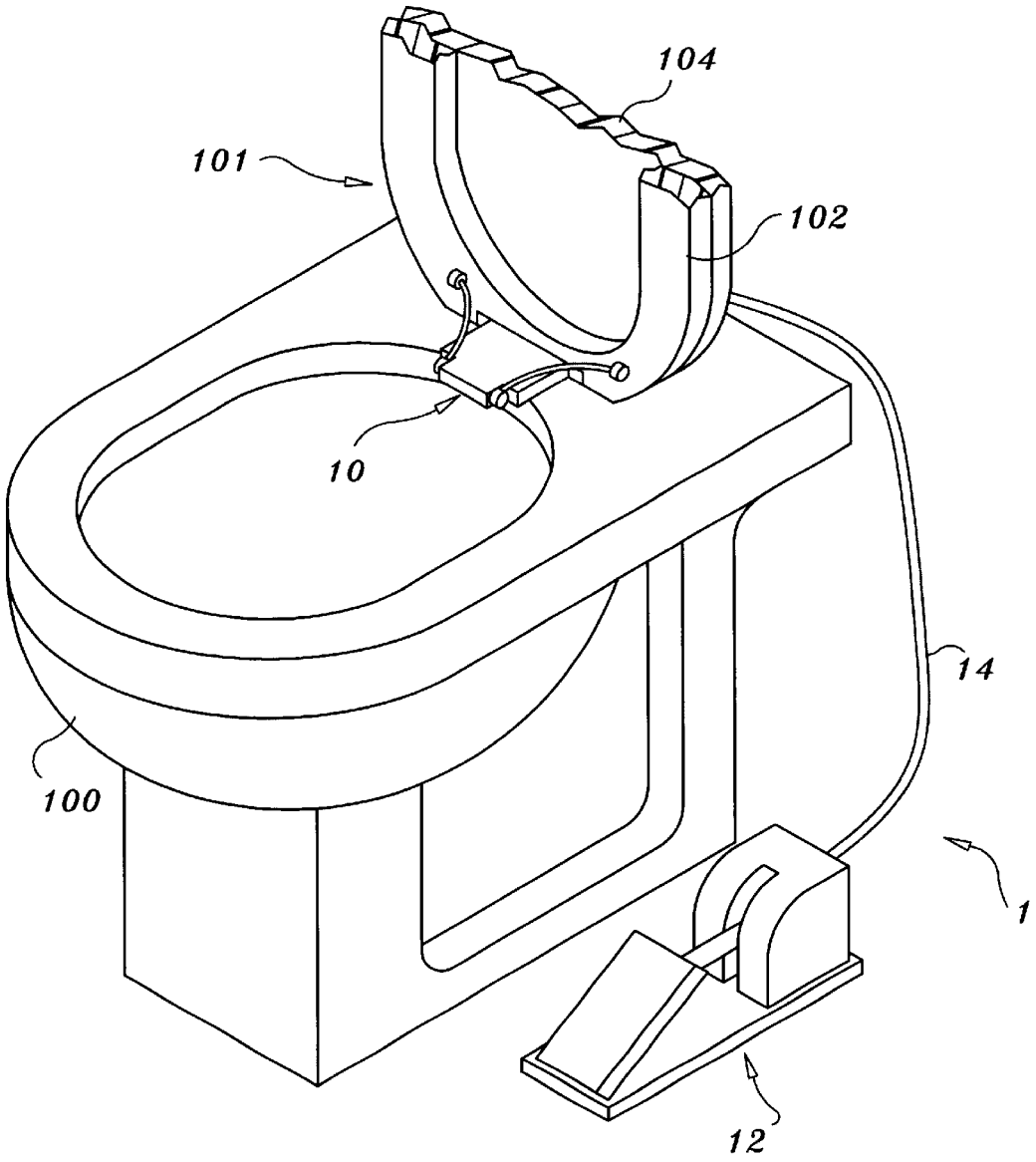
FIG. 1 is a perspective view of a toilet seat lifter installed on a toilet with the toilet seat in an upright position in accordance with the present invention.
Figure 2:
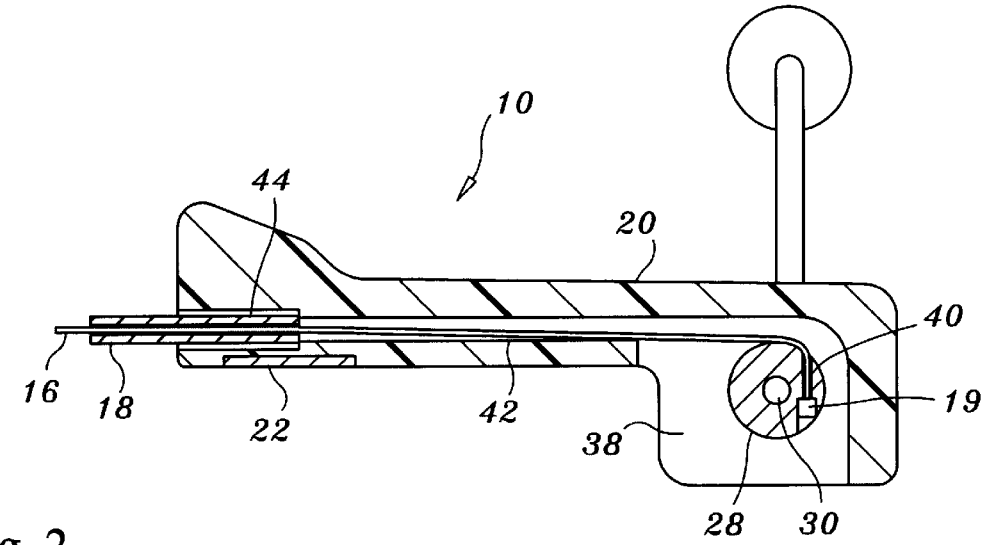
FIG. 2 is a cross sectional view of the seat lifter of the toilet seat lifter in accordance with the present invention.
Figure 3:
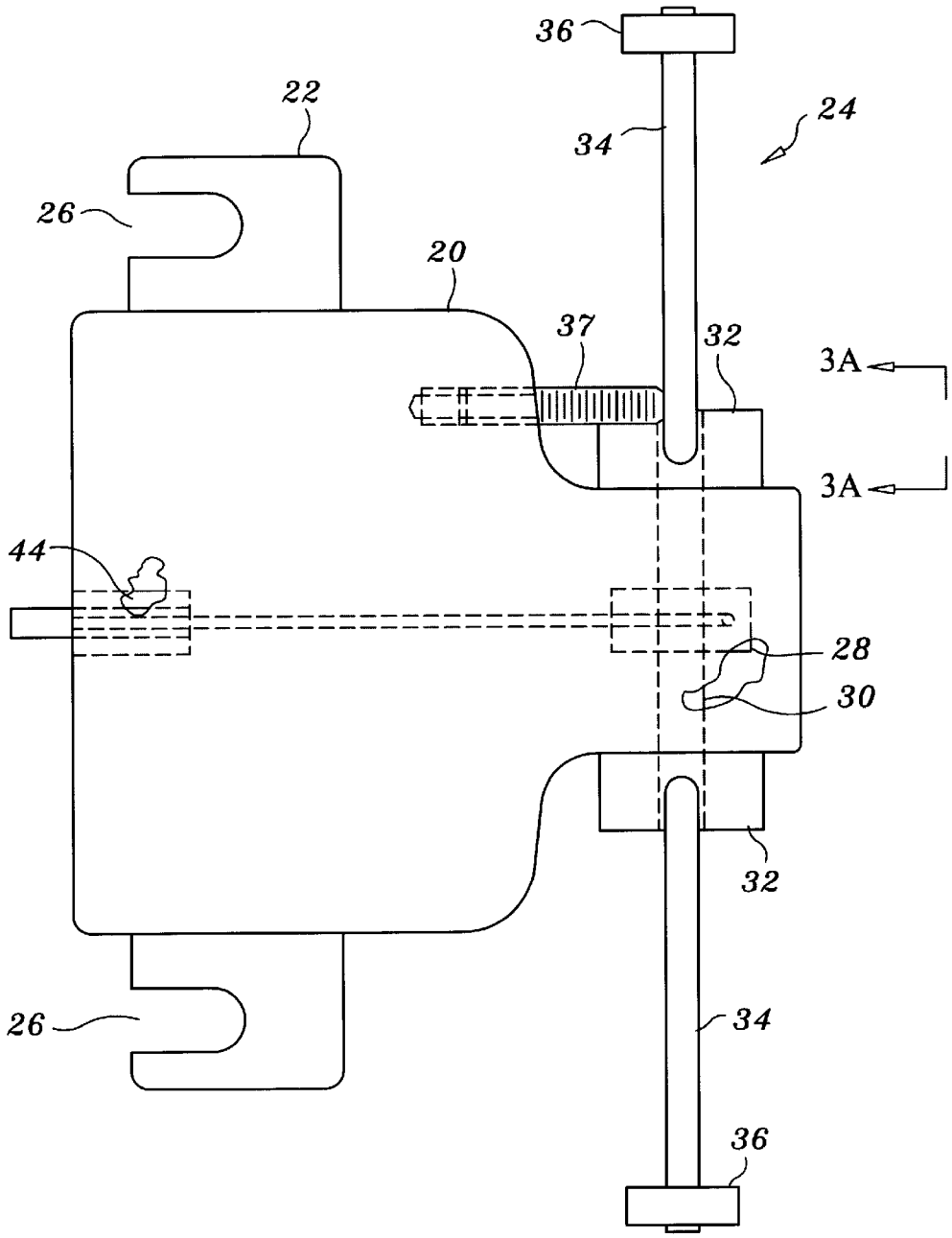
FIG. 3 is a top view of a seat lifter of the toilet seat lifter in accordance with the present invention.

With reference now to the drawings, and particularly to FIG. 1, there is shown a perspective view of a toilet seat lifter 1 installed on a toilet 100. With reference to FIGS. 2 and 3, the toilet seat lifter 1 includes a seat lifter 10, a foot pedal actuator 12, and an actuation cable 14. The actuation cable 14 includes a cable 16 and a sheath 18. Preferably, the inner diameter of the sheath 18 is fabricated from a nylon material to ensure smooth motion of the cable 16, but other materials or coatings may also be used. The seat lifter 10 includes a lifter base 20, an attachment plate 22, and at least one lifter arm 24. Preferably, the attachment plate 22 is fastened to a bottom of the lifter base 20 with fasteners or any other suitable fastening method. However, the lifter base 20 and the attachment plate 22 may be fabricated from a single piece of material. The attachment plate 22 includes bolt slots 26 for retention of the seat lifter 10 by anchor bolts 110 of the toilet seat assembly 101.

The at least one lifter arm 24 is pivotally retained by the lifter base 20 at the end opposite the attachment plate 22. The at least one lifter arm 24 preferably includes a cable pulley 28, a pulley axle 30, at least one drive wheel 32, at least one pivot arm 34, and at least one roller 36. The cable pulley 28 is rigidly attached to the pulley axle 30. A pulley cavity 38 is formed in a bottom of the lifter base 20 to provide clearance for the cable pulley 28. The pulley axle 30 is pivotally retained by the lifter base 20. The pulley axle 30 extends beyond at least one side of the lifter base 20 such that at least one of the drive wheels 32 may be attached thereto.

Figure 3A:
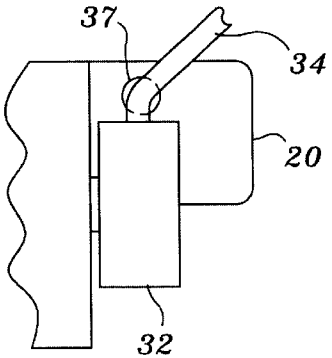
FIG. 3*a* is a partial front view of a seat lifter of the toilet seat lifter in accordance with the present invention.

Preferably, a single pivot arm 34 is inserted into each drive wheel 32 and retained thereby. A single roller 36 is pivotally retained on an end of each pivot arm 34 with any suitable retention method. With reference to FIG. 3*a*, an adjustable stop 37 extends from the lifter base 20, adjacent one of the lifter arms 34. The adjustable stop 37 is preferably a set screw, but other devices or methods may also be used to prevent the at least one lifter arm 24 from traveling too far backwards.

Preferably, a hole 40 is formed through the cable pulley 28 for the insertion of the cable 16. A first cable end 19 is formed on the end of the cable 16 to retain thereof in the cable pulley 28. A cable hole 42 is formed through the lifter body 20 from an attachment end thereof to the pulley cavity 38. A sheath clearance 44 is preferably formed in the attachment end for retention of the sheath 18. Pulling of the cable 16 will cause the at least one lifter arm 24 to rotate and lift a toilet seat 102 and toilet lid 104.

Figure 6:
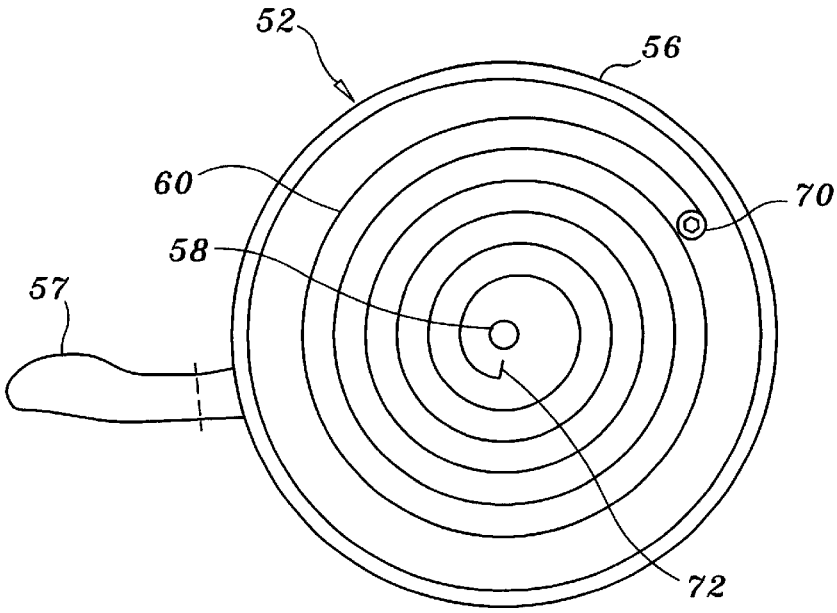
FIG. 6 is a side view of a spring load disc of a toilet seat lifter in accordance with the present invention.
Figure 4:
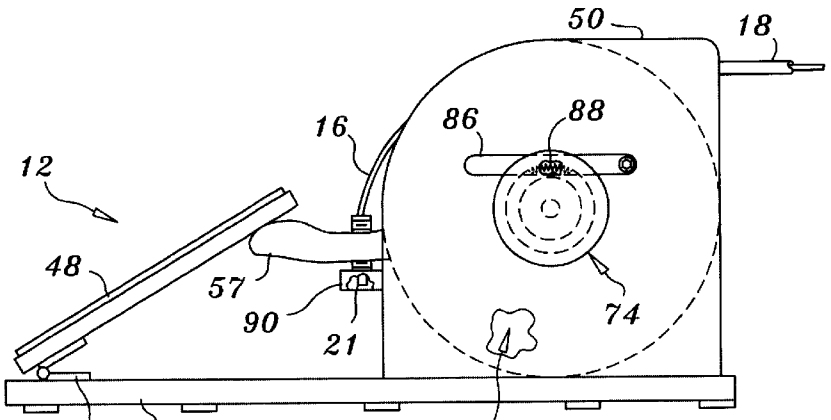
FIG. 4 is a side view of a foot pedal actuator of a toilet seat lifter in accordance with the present invention.
Figure 5:
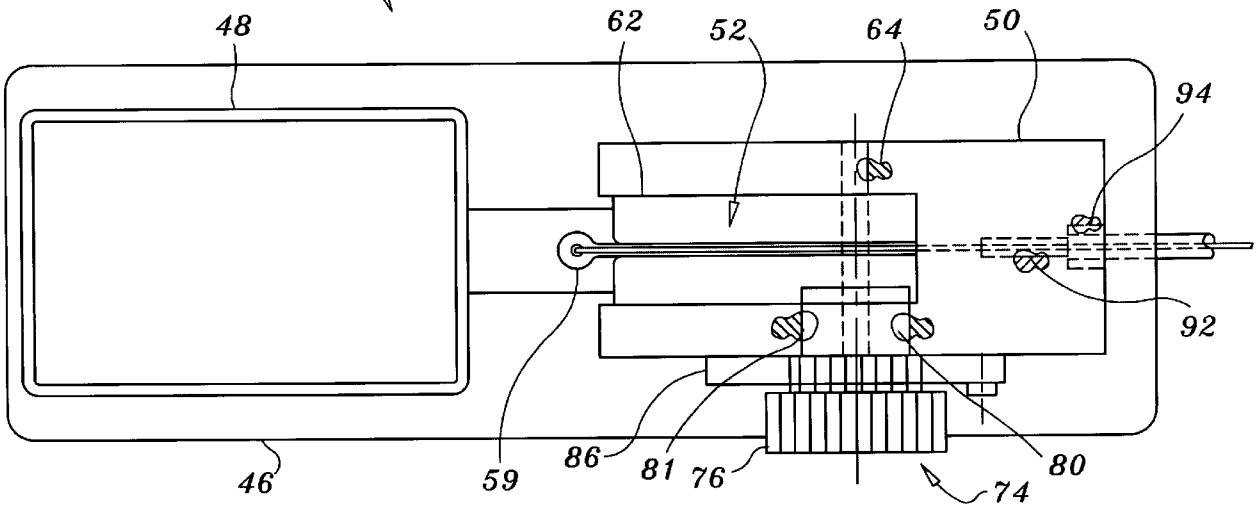
FIG. 5 is a top view of a foot pedal actuator of a toilet seat lifter in accordance with the present invention.
Figure 7:
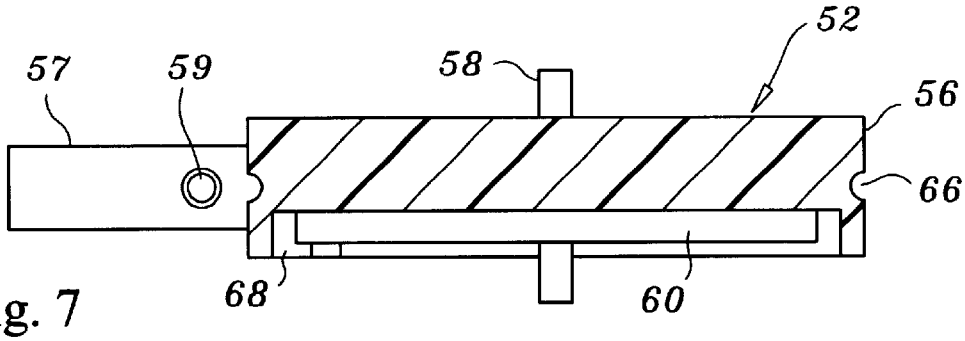
FIG. 7 is a cut-away view of a spring load disc of a toilet seat lifter in accordance with the present invention.

With reference to FIGS. 4–6, the foot pedal actuator 12 includes a foot base 46, a foot pedal 48, a disc yoke 50, and a spring loaded disc 52. The disc yoke 50 is attached to the foot base 46 with any suitable fastening method. The foot pedal 48 is pivotally attached to an end of the foot base 46 with a hinge 54 or the like. With reference to FIG. 7, the spring loaded disc 52 includes a disc body 56, a pedal projection 57, a disc axle 58, and a torsion spring 60. The disc axle 58 extends beyond a width of the disc body 56. A disc cavity 62 is formed in the disc yoke 50 to receive spring loaded disc 52. The spring loaded disc 52 is pivotally retained in the disc yoke 50 by pushing the disc axle 58 through a bore in the disc yoke 50 and the spring loaded disc 52.

A cable groove 66 is formed in the outer diameter of the disc body 56 to receive the cable 16. A spring bore 68 is formed in a face of the disc body 56 to receive the torsion spring 60. One end of the torsion spring 60 is curled and retained by a fastener 70 at a wall of the spring bore 68. A small portion of the other end 72 of the torsion spring 60 is bent substantially perpendicular.

Figure 8:
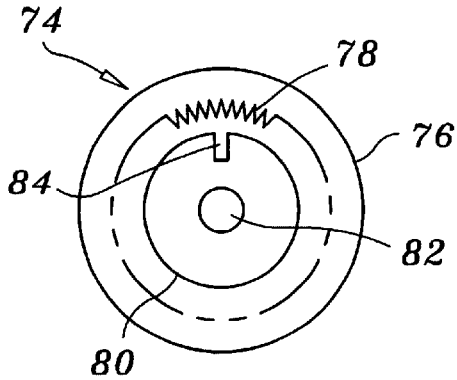
FIG. 8 is an end view of a spring tensioning knob of a toilet seat lifter in accordance with the present invention.

With reference to FIG. 8, a ratchet knob 74 includes a gripping surface 76, a rotary ratchet surface 78, and rotable body 80. A knob bore 81 is formed in the disc yoke 50 to rotatably receive the rotable body 80. An axle bore 82 is formed through the ratchet knob 74 to rotatably receive one end of the disc axle 58. A spring slot 84 is formed in the rotable body 80 to receive the other end 72 of the torsion spring 60. A pawl 86 is pivotally attached to a side of the disc yoke 50. The pawl 86 includes a pawl ratchet surface 88 which is engagable with the rotary ratchet surface 78 of the ratchet knob 74.

The rotating the ratchet knob 74 preloads the torsion spring 60 with spring tension. The greater the preload of the torsion spring 60, the less the foot pressure required to lift the toilet seat 102. Greater torsion preload is required for heaver toilet seats. Further, the tighter the torsion spring 60, the slower the descent of the toilet seat 102, once the foot pedal is released. The ratchet knob 74 is locked in place by the pawl 86. If the descent of the toilet seat is too slow, the user may grasp the ratchet knob 74, lift the pawl 86, and let the ratchet knob 74 turn backwards slightly. However, the toilet seat lifter 1 will operate without inclusion of the torsion spring 60, ratchet knob 74, and pawl 86.

The pedal projection 57 extends outward from the outer diameter of the disc body 56. The pedal projection 57 includes a threaded tap 59 which is sized to threadably receive a cable barrel 90. A second cable end 21 is retained by the cable barrel 90. Threading the cable barrel 90 into the pedal projection 57 decreases the final height of the toilet seat 102. Threading the cable barrel 90 out-of-the pedal projection increases the final height of the toilet seat 102. A cable hole 92 is formed through the disc yoke 50 adjacent the cable groove 66 in the disc body 56. Preferably, a sheath clearance 94 is formed in an end of the disc yoke 50 to receive the sheath 18.

Figure 9:
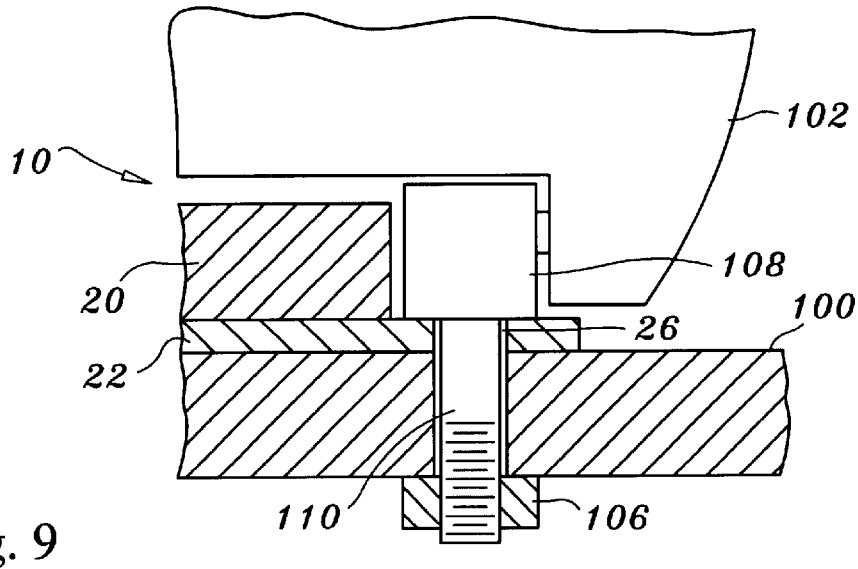
FIG. 9 is an enlarged cross sectional view of a seat lifter retained under a toilet seat assembly in accordance with the present invention.

With reference to FIG. 9, the seat lifter 10 is installed by loosening each nut 106 which retains the toilet seat assembly 101 against the toilet 100. The attachment plate 22 is slipped between each bolt retainer 108 and the toilet 100. The at least one lifter arm 24 must be below the toilet seat 102. Each bolt slot 26 is slipped around a single anchor bolt 110. The nuts 106 are tighten and the seat lifter 10 is retained in place. The foot pedal actuator 12 may be located wherever the user desires. Preferably, a plurality of nonslip feet 96 are located on a bottom of the foot base 46 to retain the foot pedal actuator 12 wherever the user desires. The toilet seat 102 in a down position forces the foot pedal 48 upward. To lift the toilet seat 102, the user presses their foot on the foot pedal 48 which causes the at least one lifter arm 24 to rotate and push the toilet seat 102 upward. When the user takes their foot off the foot pedal 48, the torsion spring cushions the descent of the toilet seat 102.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A toilet seat lifter comprising:

an actuation cable including a cable and a sheath;

a seat lifter including a lifter base and at least one lifter arm, said at least one lifter arm being pivotally retained by said lifter base, said lifter base being retained adjacent a toilet retainer of a toilet, one end of said cable being attached to said at least one lifter arm;

a foot pedal actuator including a foot base, a disc yoke, a foot pedal, and a disc body, said foot pedal being pivotally attached to said foot base, said disc yoke being attached to said foot base, a disc body being rotatably retained by said disc yoke, said disc body being capable of rotation by depression of said foot pedal, the other end of said cable being attached to said disc body, said sheath being retained between said foot base and said lifter base;

a torsion spring having one end attached to said disc body and the other end bent substantially perpendicular;

a ratchet knob having a slot sized to receive said other end of said torsion spring, a rotary ratchet surface being formed on a perimeter of said ratchet knob; and a pawl being pivotally attached to said disc yoke, said pawl engaging the ratchet surface of said ratchet knob.

2. The toilet seat lifter of claim 1, further comprising:

a pedal projection extending from an outer perimeter of said disc body, said foot pedal being engagable with said pedal projection.

3. The toilet seat lifter of claim 1, further comprising:

said at least one lifter arm including a cable pulley, at least one pivot arm, and at least one roller, one end of said cable being attached to said cable pulley, one of said at least one roller being pivotally retained on an end of one of said at least one pivot arm.

4. The toilet seat lifter of claim 1 wherein:

said lifter base including a pair of bolt slots which are capable of being inserted around a pair anchor bolts of a toilet seat assembly.

5. A method of lifting a toilet seat comprising the steps of:

providing a seat lifter capable of being retained between a toilet and toilet seat assembly, said seat litter including at least one pivoting arm capable of lifting a toilet seat;

providing an actuation cable capable of causing said at least one pivoting arm to rotate when a cable of said actuation cable is pulled;

providing a foot pedal actuator that is capable of pulling said cable by depression of a foot pedal of said foot pedal actuator, said foot pedal actuator including a foot base, a disc yoke, and said foot pedal, said foot pedal being pivotally attached to said foot base, said disc yoke being attached to said foot base, a disc body being rotatably retained by said disc yoke, said disc body being capable of rotation by depression of said foot pedal;

lifting a toilet seat by depressing said foot pedal;

providing a torsion spring having one end attached to said disc body and the other end bent substantially perpendicular;

providing a ratchet knob having a slot sized to receive said other end of said torsion spring, a rotary ratchet surface being formed on a perimeter of said ratchet knob; and providing a pawl pivotally attached to said disc yoke, said pawl engaging the ratchet surface of said ratchet knob.

6. The method of lifting a toilet seat of claim 5, further comprising:

a pedal projection extending from an outer perimeter of said disc body, said foot pedal being engagable with said pedal projection.

7. The method of lifting a toilet seat of claim 5, further comprising the step of:

biasing said cable with spring pressure to ensure a cushioned descent of said toilet seat when said foot pedal is released.

8. The method of lifting a toilet seat of claim 5, further comprising:

said at least one lifter arm including a cable pulley, at least one pivot arm, and at least one roller, one end of said cable being attached to said cable pulley, one of said at least one roller being pivotally retained on an end of one of said at least one pivot arm.

9. The method of lifting a toilet seat of claim 5 wherein:

said lifter base including a pair of bolt slots which are capable of being inserted around a pair anchor bolts of a toilet seat assembly.

10. A method of lifting a toilet seat comprising the steps of:

providing a seat lifter capable of being retained between a toilet and toilet seat assembly, said seat lifter including at least one pivoting arm capable of lifting a toilet seat;

providing an actuation cable capable of causing said at least one pivoting arm to rotate when said cable is pulled;

providing a foot pedal actuator that is capable of pulling said cable by depression of a foot pedal of said foot pedal actuator, said foot pedal actuator including a foot base, a disc yoke, and said foot pedal, said foot pedal being pivotally attached to said foot base, said disc yoke being attached to said foot base, a disc body being rotatably retained by said disc yoke, said disc body being capable of rotation by depression of said foot pedal;

lifting a toilet seat by depressing said foot pedal;

biasing said cable with spring pressure to ensure a cushioned descent of said toilet seat when said foot pedal is released;

providing a torsion spring having one end attached to said disc body and the other end bent substantially perpendicular;

providing a ratchet knob having a slot sized to receive said other end of said torsion spring, a rotary ratchet surface being formed on a perimeter of said ratchet knob; and providing a pawl pivotally attached to said disc yoke, said pawl engaging the ratchet surface of said ratchet knob.

11. The method of lifting a toilet seat of claim 10, further comprising:

said at least one lifter arm including a cable pulley, at least one pivot arm, and at least one roller, one end of said cable being attached to said cable pulley, one of said at least one roller being pivotally retained on an end of one of said at least one pivot arm.

12. The method of lifting a toilet seat of claim 10, further comprising:

a pedal projection extending from an outer perimeter of said disc body, said foot pedal being engagable with said pedal projection.

13. The method of lifting a toilet seat of claim 10, wherein:

said seat lifter including a pair of bolt slots which are capable of being inserted around a pair bolts of a toilet seat assembly.

* * * * *